US012534903B2

(12) United States Patent
Evans et al.

(10) Patent No.: US 12,534,903 B2
(45) **Date of Patent: *Jan. 27, 2026**

(54) DRYWALL SPACING JOIST HANGER

(71) Applicant: Simpson Strong-Tie Company Inc., Pleasanton, CA (US)

(72) Inventors: Thomas G. Evans, Dublin, CA (US); Paul Bernard McEntee, Fremont, CA (US); James M. Benton, Tracy, CA (US); Emory Lee Montague, Pleasanton, CA (US); Timothy Patrick Murphy, Tracy, CA (US)

(73) Assignee: Simpson Strong-Tie Co. Inc., Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/576,983

(22) Filed: Jan. 16, 2022

(65) Prior Publication Data

US 2022/0243455 A1 Aug. 4, 2022

Related U.S. Application Data

(63) Continuation of application No. 16/370,582, filed on Mar. 29, 2019, now Pat. No. 11,225,787, which is a (Continued)

(51) Int. Cl.
*E04B 1/26* (2006.01)
*E04B 5/14* (2006.01)
(Continued)

(52) U.S. Cl.
CPC ..... *E04B 1/2612* (2013.01); *E04B 5/14* (2013.01); *E04C 3/125* (2013.01); *E04C 3/292* (2013.01)

(58) Field of Classification Search
CPC .... E04B 1/2608; E04B 1/2612; E04B 1/5818; E04B 2001/2415; E04B 1/185; E05B 5/12; F16B 5/0614
(Continued)

(56) References Cited

U.S. PATENT DOCUMENTS 537,505 A 4/1895 Van
1,097,934 A 5/1914 Price
(Continued)

FOREIGN PATENT DOCUMENTS

EP 0 210 744 2/1987
EP 1672133 6/2006
(Continued)

OTHER PUBLICATIONS

Simpson Strong-Tie, "Wood Construction Connectors: 2013-2014", pages: front cover, 69, 78, 83, 86, 89, 91, 100, 108, 110, 118, 134, 162, back cover, C-2013, Simpson Strong-Tie Company, Inc., Pleasanton, California, USA.
(Continued)

*Primary Examiner* — James J Buckle, Jr.
(74) *Attorney, Agent, or Firm* — Charles R. Cypher

(57) ABSTRACT

A connection utilizing a joist hanger to hang a joist or beam from a wood structural support member such as a top plate or header in cooperation with a first plurality of fasteners such as screws or nails and one or more substantially vertical fire-resistant panels such as drywall.

5 Claims, 15 Drawing Sheets

Related U.S. Application Data continuation-in-part of application No. 16/001,821, filed on Jun. 6, 2018, now Pat. No. 11,142,902.

(51) Int. Cl.
*E04C 3/12* (2006.01)
*E04C 3/292* (2006.01)

(58) Field of Classification Search
USPC ..... 52/289, 699, 702, 712, 715
See application file for complete search history.

(56) References Cited

U.S. PATENT DOCUMENTS 1,300,132 A 4/1919 Dessauer
1,692,351 A 11/1928 Ropp
1,728,981 A 9/1929 Ropp
1,792,815 A 2/1931 Chapin
2,461,145 A 2/1949 Craver
2,495,408 A 1/1950 Christoffersen
2,717,801 A 9/1955 Neil
2,815,546 A 12/1957 Kenk
2,911,690 A 11/1959 Sanford
3,125,785 A 3/1964 Conville
3,337,946 A 8/1967 Anderson et al.
3,420,560 A 1/1969 Pfahning
3,601,428 A 8/1971 Gilb
3,837,135 A 9/1974 Zachman
3,907,445 A 9/1975 Wendt
3,945,741 A 3/1976 Wendt
3,972,169 A 8/1976 Sheppard, Jr.
3,989,398 A 11/1976 Wendt
4,005,942 A 2/1977 Gilb
4,038,796 A 8/1977 Eckel
4,077,176 A 3/1978 Bauer
4,158,940 A 6/1979 Lancelot, III et al.
4,196,556 A 4/1980 Russo
4,261,155 A 4/1981 Gilb
4,283,892 A 8/1981 Brown
4,330,971 A 5/1982 Auberger
4,353,664 A 10/1982 Gilb
4,411,548 A 10/1983 Tschan
4,422,792 A 12/1983 Gilb
4,423,977 A 1/1984 Gilb
4,455,805 A 6/1984 Rionda et al.
4,480,941 A 11/1984 Gilb et al.
4,498,801 A 2/1985 Gilb
4,527,375 A 7/1985 Braginetz
4,555,887 A 12/1985 Rionda et al.
4,561,230 A 12/1985 Rionda et al.
4,764,069 A 8/1988 Reinwall
4,811,542 A 3/1989 Jewell
4,841,690 A 6/1989 Commins
4,893,961 A 1/1990 O'Sullivan et al.
4,920,725 A 5/1990 Gore
4,949,929 A 8/1990 Kesselman et al.
4,953,339 A 9/1990 Jewell
4,957,186 A 9/1990 Reetz
4,982,548 A 1/1991 Abbey
5,042,217 A 8/1991 Bugbee et al.
5,054,755 A 10/1991 Hawkes
5,058,358 A 10/1991 Stratton
5,071,280 A 12/1991 Turner
5,104,252 A 4/1992 Colonias et al.
5,111,632 A 5/1992 Turner
5,201,156 A 4/1993 Newman
5,220,766 A 6/1993 Hills, Sr.
5,228,261 A 7/1993 Watkins
5,240,342 A 8/1993 Kresa, Jr.
5,394,668 A 3/1995 Lim
5,437,137 A 8/1995 Allen
5,551,135 A 9/1996 Powers, III
5,555,694 A 9/1996 Commins
5,564,248 A 10/1996 Callies
5,598,680 A 2/1997 Wilhelmi
5,603,580 A 2/1997 Leek et al.
5,625,995 A 5/1997 Martin
5,657,596 A 8/1997 Powers, III
5,692,864 A 12/1997 Powell et al.
5,740,643 A 4/1998 Huntley
5,755,070 A 5/1998 Hohmann
5,778,625 A * 7/1998 Druffel ..... H02G 3/20 52/576
5,829,216 A 11/1998 Newcomb et al.
5,836,131 A 11/1998 Viola et al.
5,845,453 A 12/1998 Goya
6,079,176 A * 6/2000 Westra ..... E04G 9/10 52/700
6,101,780 A 8/2000 Kreidt
6,123,745 A * 9/2000 Hess, III ..... E02D 27/013 52/700
6,131,358 A 10/2000 Wise
6,254,306 B1 7/2001 Williams
6,295,773 B1 10/2001 Alty
6,397,552 B1 6/2002 Bourque
6,427,391 B1 8/2002 Lyons
6,463,711 B1 10/2002 Callies
6,523,321 B1 2/2003 Leek et al.
6,662,511 B1 12/2003 Alty
6,817,157 B2 11/2004 Bourque
6,845,594 B2 1/2005 Harber
6,945,004 B1 9/2005 Ghiringhelli
7,024,833 B1 4/2006 Rice
7,254,926 B2 8/2007 Eldeen
7,334,372 B2 2/2008 Evans et al.
7,343,712 B2 * 3/2008 Shelton ..... E04G 23/0218 52/289
7,448,178 B2 * 11/2008 Visone ..... E04B 1/2612 428/584
7,461,494 B2 12/2008 Frezza
8,051,620 B2 11/2011 Kittlitz et al.
8,322,096 B2 12/2012 Visser
8,387,333 B2 3/2013 Brekke
8,443,569 B2 5/2013 Sias
8,621,802 B2 1/2014 Spryou
8,966,857 B2 3/2015 Pope
9,115,489 B2 8/2015 Bourdon
9,151,058 B1 10/2015 Leathe
9,206,594 B1 * 12/2015 Grevious ..... F16B 7/0486
9,228,338 B2 1/2016 Lin
9,394,680 B2 * 7/2016 Bundy ..... E04B 1/2612
10,184,242 B2 1/2019 Brekke
10,260,232 B1 4/2019 Conboy
10,358,812 B2 7/2019 Jensen et al.
10,653,904 B2 5/2020 Conboy
10,814,150 B2 10/2020 Conboy
10,899,038 B2 1/2021 Conboy
2002/0078656 A1 6/2002 Leek et al.
2004/0244328 A1 * 12/2004 Bak ..... E04B 1/2612 52/715
2005/0155307 A1 7/2005 Timony
2006/0130414 A1 6/2006 Walther
2006/0191233 A1 * 8/2006 Tamlyn ..... E04B 1/2612 52/702
2007/0294979 A1 * 12/2007 Lin ..... E04B 1/2612 52/702
2008/0101855 A1 * 5/2008 Lin ..... F16B 9/058 403/232.1
2008/0163568 A1 7/2008 Shelton
2008/0202059 A1 8/2008 McCollough
2008/0237421 A1 10/2008 Szpotowski
2009/0113839 A1 * 5/2009 Carr ..... E04B 1/2612 52/712
2012/0137612 A1 6/2012 Buckholdt
2012/0222382 A1 * 9/2012 Brekke ..... E04B 1/2612 52/702
2012/0297724 A1 * 11/2012 Pope ..... E04B 1/2612 52/702
2013/0067850 A1 3/2013 Sasanecki
2015/0167291 A1 * 6/2015 Bundy ..... E04B 1/2612 52/702

(56) References Cited

U.S. PATENT DOCUMENTS

| | | | | |
|---|---|---|---|---|
| 2015/0184370 | A1* | 7/2015 | Brekke | E04B 1/2612 52/708 |
| 2017/0342701 | A1 | 11/2017 | Brekke | |
| 2018/0038094 | A1* | 2/2018 | Brekke | E04B 1/2612 |

FOREIGN PATENT DOCUMENTS

| | | | |
|---|---|---|---|
| ES | 2224819 | | 10/2002 |
| FR | 2609742 | | 7/1988 |
| GB | 185694 | | 9/1922 |
| GB | 574457 | | 1/1946 |
| GB | 678979 | | 9/1952 |
| GB | 726794 | | 3/1955 |
| GB | 2 397 829 | A | 8/2004 |
| GB | 2 443 483 | A | 5/2008 |
| GB | 2 451 853 | A | 2/2009 |
| GB | 2452292 | | 3/2009 |
| GB | 2 433 522 | B | 7/2010 |
| GB | 2472692 | | 2/2011 |
| JP | 3-14482 | | 3/1991 |
| JP | 3206225 | | 9/1991 |
| JP | 5-19406 | | 3/1993 |
| JP | 2515383 | | 10/1996 |
| JP | 2537712 | | 6/1997 |
| JP | 10088668 | | 4/1998 |
| JP | 10-159182 | | 6/1998 |
| JP | 11-62253 | | 3/1999 |
| JP | 2941921 | | 6/1999 |
| JP | 2000-96739 | | 4/2000 |
| JP | 3964051 | | 8/2007 |
| WO | WO 2008 035 098 | A2 | 3/2008 |
| WO | WO 2011/033289 | A1 | 3/2011 |

OTHER PUBLICATIONS

Patent Cooperation Treaty (PCT), The International Search Report and The Written Opinion of the International Searching Authority, or the Declaration: PCT/US2014/070142, Apr. 15, 2015, 11 pages, International Searching Authority, European Patent Office, Rijswijk, The Netherlands.

Stormer, Russell D., Office Action in US Reissue U.S. Appl. No. 16/040,467, filed Aug. 15, 2019, 8 pages, US Patent and Trademark Office, Alexandria, Virginia, USA.

Simpson Strong-Tie Company Inc., Top-Flange Joist Hangers Installed on Walls Over Wood Structural Panel Sheathing or Drywall, Technical Bulletin, 2013, 2 pages, Simpson Strong-Tie Company Inc., Pleasanton, United States.

Simpson Strong-Tie Company Inc., Connectors for Wood Construction Product & Instruction Manual, Jan. 1, 1995, Cover page, p. 36, back cover, Simpson Strong-Tie Company Inc., Pleasanton, United States.

Simpson Strong-Tie Company Inc., Wood Construction Connectors 2014 Addendum (C-2013), 2013, Cover page, pp. 4, 14, 15 and back cover, Simpson Strong-Tie Company Inc., Pleasanton, United States.

* cited by examiner

DRYWALL SPACING JOIST HANGER

FIELD OF INVENTION

The present invention relates to building construction, and more particularly to a joist hanger adapted to secure a joist to a wall or other structural support member with one or more drywall panels disposed between the end of the joist and the front surface of the structural support member.

BACKGROUND

Joist hangers are used in building construction to secure the ends of joists or other members to walls, headers and/or other support members. Typically, the joist hanger includes a u-shaped portion that receives the joist. The bottom surface of the joist rests on the seat of the hanger, and the side walls of the hanger are dimensioned to closely receive the side faces of the joist, providing it with lateral support.

Where appropriate, the joist may be connected to the hanger by means of nails driven through the side walls into the side faces of the joist. These nails may simply be driven horizontally into the joist, in which case they are preferably short nails that will not pass all the way through the joist. Alternatively, longer nails may be used that are driven horizontally and at an acute angle into the joist such that they are driven into the header as well. This has been referred to as double-shear nailing. The other common way to nail the hanger to the joist is to use short nails that are driven downward at an angle into the joist only.

Often, in order to connect the joist hanger to the header, back flanges are attached to the side walls. Generally, these flanges extend laterally from the side walls, to overlap a portion of the face of the wall. These flanges can extend inwardly or outwardly from the side walls, depending on design considerations.

Openings may be provided in the back flanges to receive fasteners. These fasteners are generally nails in light-frame wood construction. Screws and bolts are also used in wood construction, depending on the size of the members to be joined and other considerations. In light-gauge steel construction, sheet metal screws, bolts and rivets are commonly used.

In perhaps the simplest hangers, the back flanges extend outwardly from the side flanges, providing an easily-accessed fastening face. Fasteners are then driven though the back flanges into the support wall. In other instances, design considerations dictate which particular attachment method is used for attaching the joist and the hanger to the support wall.

In addition, top flanges may be attached to the back flanges to aid in attaching the hanger to the support wall. Hangers with top flanges are generally referred to as top-flange hangers. Hangers without top flanges are generally referred to as face-mount hangers. If the top flanges wrap over the top of the header and down the back of the header, the hanger can be called a wrap-around hanger. Again, various design considerations dictate what features are present in a hanger, and various building considerations dictate which hanger, or type of hanger, is used in a particular situation. Generally, if a top flange is used and the header is made of wood, pre-formed holes are provided in the top flanges to receive suitable fasteners for connecting the top flange to the header. Such fastener openings may not be present in light-gauge steel construction because the hanger is typically fastened to the support wall with self-drilling sheet metal screws or by welding.

As mentioned above, it is often desirable to fasten the joist to the hanger. This is generally done to resist uplift forces acting on the joist. Such forces are often caused by lateral loading on the building due to high winds or seismic activity. Also, one end of a joist must be downwardly restrained if that joist is cantilevered (e.g., to support an overhanging deck). As mentioned above, openings may be provided in the side walls of the hanger so that the joist can be held down with fasteners driven through the openings and into the joist.

Drywall is used in fire barriers, but it can be difficult to shield supporting structural members like top plates and headers at the connection between the supporting wall and a supported joist, because drywall is susceptible to cracking and crushing and has little bearing strength with regard to fasteners received in the drywall. The present invention allows drywall to be easily applied to the supporting structural members, providing some shielding from fire and heat, and provides a joist hanger connection that still allows the drywall to serve as a fire barrier. Importantly, the present invention does not require additional components. The drywall can simply be notched where the projecting side walls of the hanger will pass through the drywall, and then the drywall is inserted between the end of the joist and the wall.

The present invention uses sufficiently strong material for the side walls and the back flanges of the hanger such that they can hold the hanger away from the header and against the one or more drywall panels disposed between the joist and the support member without sagging. The hanger bears the load of the joist without crushing the drywall either during installation or use.

SUMMARY OF THE INVENTION

The present invention provides a connection that allows a joist hanger carrying a joist to be attached to a supporting structural member with fire-resisting, drywall panels interposed between the end of the joist and the supporting structural member such that the drywall panels can help shield the supporting structural member from damage from fire, while providing a strong connection between the joist and the supporting structural member.

The present invention provides a connection in which a joist hanger is fastened to a structural member with drywall panels that have little or no dowel bearing strength being interposed between the end of the joist and the surface of the structural member. The drywall panels cover enough of the end of the joist and enough of the surface of the structural member such that the drywall panels provide some protection to the structural member from the effects of fire.

The present invention provides a connection in which a portion of the joist hanger is held away from the supporting structural member to which it is attached. The present invention provides a joist hanger that has side walls or side members that extend through the one or more drywall panels interposed between the portion of the joist hanger that receives the joist and the supporting structural member. The present invention allows drywall panels to be placed over a supporting structural member thereby providing some shielding from the deleterious effects of fire and heat, with substantial portions of the top edges of the drywall panels reaching at least as high as the top of the structural support member.

The present invention provides a connection in which the joist hanger is provided with a stand-off member for holding the joist away from the support wall.

In one form of the joist hanger, the stand-off is attached to the back plate member or top flange of the joist hanger.

In one form of the joist hanger, the stand-off is attached to one or more of the side walls of the joist hanger.

The present invention provides a connection in which the joist hanger is connected to the supporting structural member by cantilevered side walls that extend through the one or more drywall panels.

The present invention provides a joist hanger that can be fastened to a structural support member with substantially non-load-bearing drywall panels being interposed between the end of the joist and the structural support member.

The present invention provides a hanger with a stand-off member that spans the distance between the end surface of the joist and the support member front face.

The present invention provides a hanger with side walls having back edges, with the upper portions of the back edges of the side walls being offset from the respective lower portions of the back edges of the side walls.

DESCRIPTION OF THE PREFERRED EMBODIMENT

Figure 1:
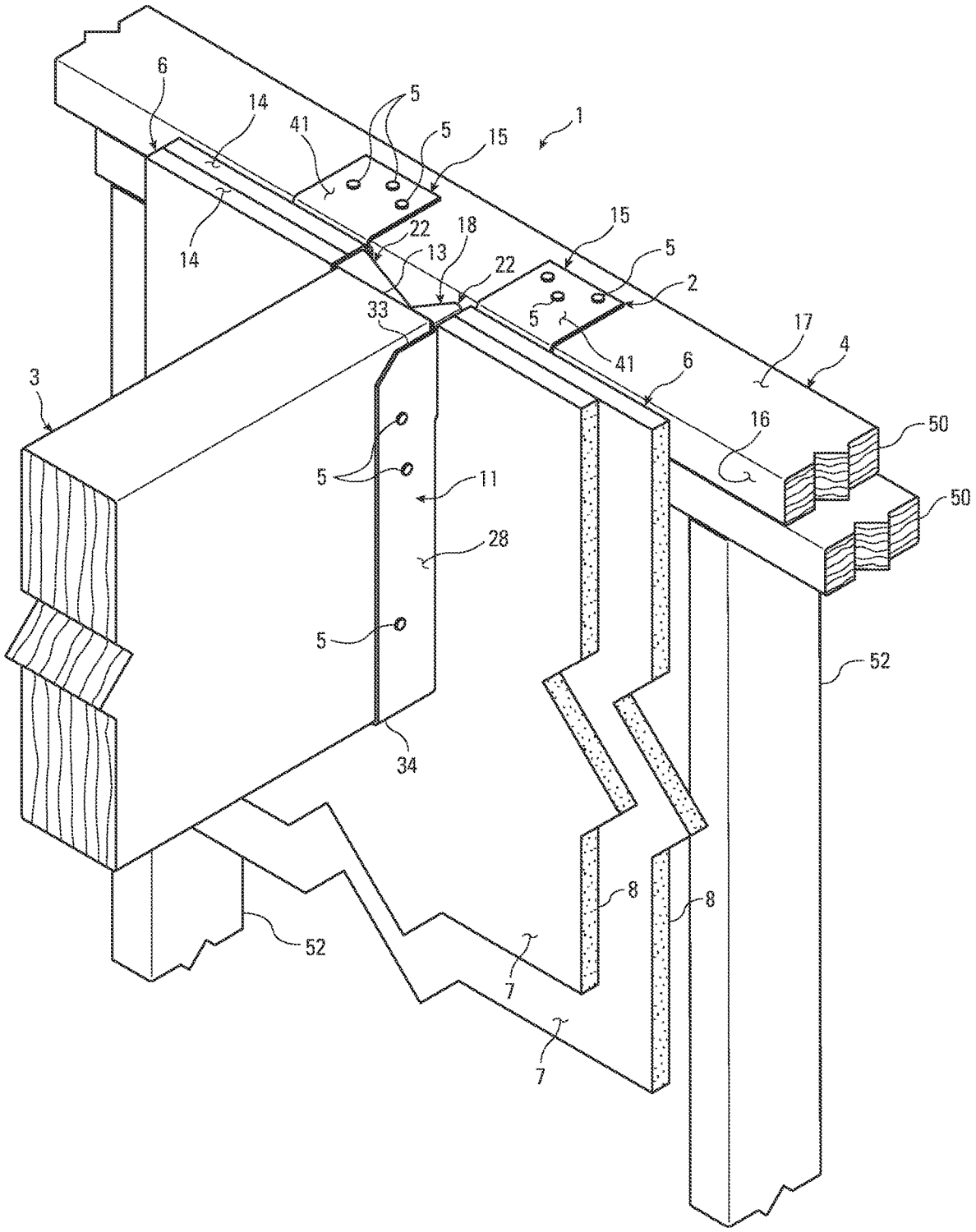
FIG. 1 is an upper right perspective view of a connection formed according to the present invention.

As shown in FIG. 1, the invention is a connection 1 utilizing a joist hanger 2 to hang a joist 3 from a structural support member 4 in cooperation with one or more fasteners 5, and one or more substantially vertical drywall panels 6 are interposed between the joist 3 and the structural support member 4.

Preferably, the one or more drywall panels 6 shield the structural support member 4, and each of the one or more fire-resistant panels 6 has a front face 7, a back face 8 opposite the front face 7, and negligible dowel bearing strength. In order to show the vertically disposed studs and top plate 4 that makes up the wall the panels 6 are not shown as covering these members completely; however, preferably the panels 6 cover all of the structural members that make up the wall to a substantial degree to help protect them from fire.

Preferably, the structural support member 4 has a substantially vertical front face 16 and significant dowel bearing strength. The joist hanger 2 preferably supports the joist 3. The joist 3 has an end face 13 spaced away from the front face 16 of the structural support member 4.

Preferably, the joist hanger 2 has one or more back plate members 9. In FIGS. 1-9, the joist hanger 2 is shown with multiple back plate member 9. In the embodiments shown in FIGS. 10-16, the joist hanger 2 has a single back plate member 9. The joist hanger 2 has a first side wall or side member 11, and a second side wall or side member 11.

The first back plate member 9 preferably has a first back face 10 in parallel registration with the front face 16 of the structural support member 4. Preferably, the second back plate member 9, if present, also has a second back face 10 in parallel registration with the front face 16 of the structural support member 4. The first side member 11 preferably is connected to the first back plate member 9. Preferably, the second side member 11 is connected to the first back plate member 9 or the second back plate member 9, if present.

Figure 2:
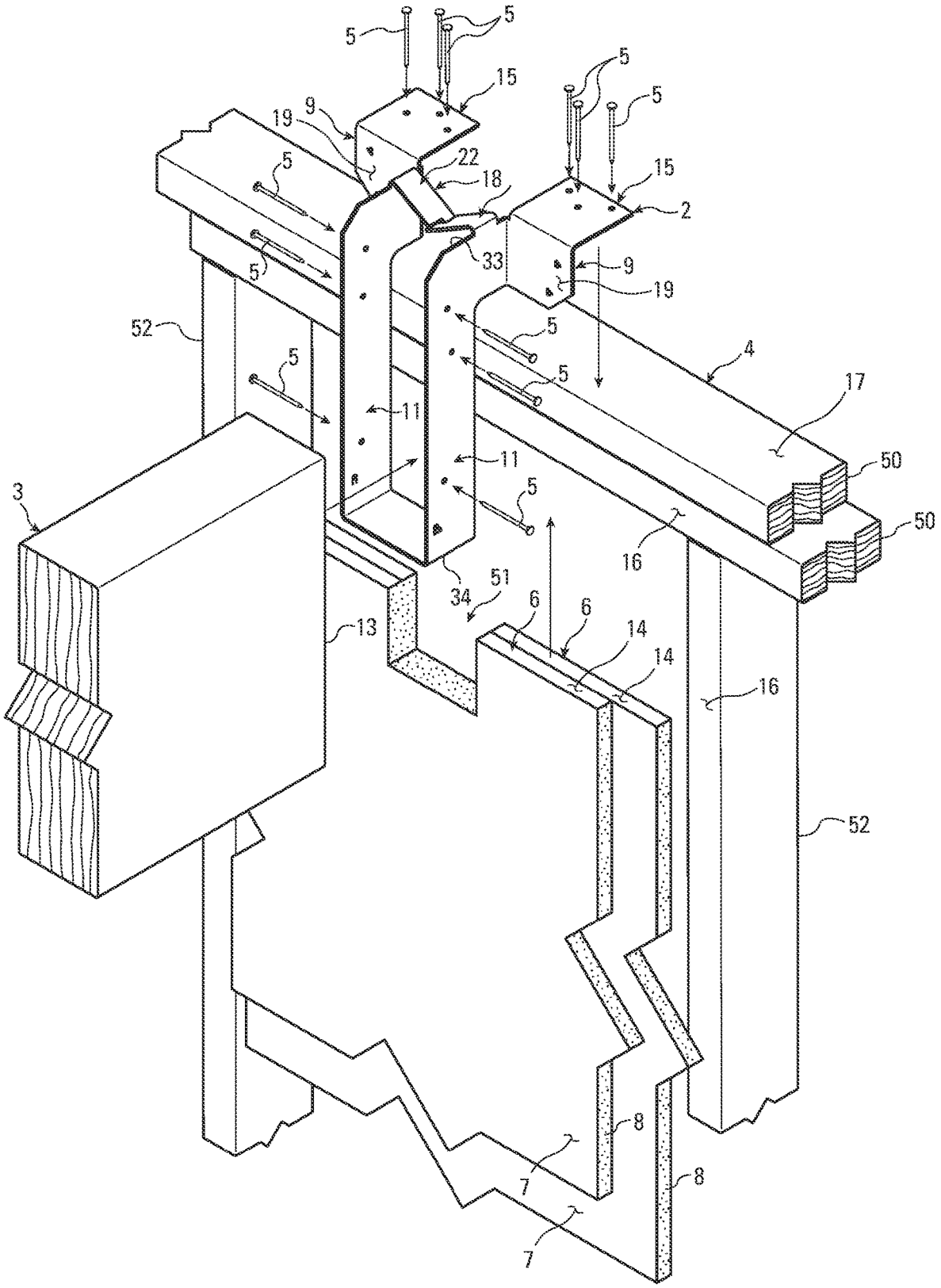
FIG. 2 is an exploded, perspective view of a connection formed according to the present invention.

As shown in FIG. 2, at least one of the first plurality of fasteners 5 preferably passes through the first back plate member 9 and into the structural support member 4. Preferably, at least one of the first plurality of fasteners 5 passes through the second back plate member 9, if present, and into the structural support member 4. The joist 3 preferably is supported by the joist hanger 2. Preferably, the one or more panels 6 are between the joist 3 and the structural support member 4 and the back face 8 of one panel 6 of the one or more panels 6 interfaces with the front face 16 of the structural support member 4.

The one or more back plate members 9 preferably are planar, with front faces 19 opposite the back faces 10. In the embodiment shown in FIGS. 1-9 with first and second back plate members 9, each has first and second inner edges 20 that preferably are linear, and first and second outer edges 21 opposite the first and second inner edges 20. The one or more back plate members 9 preferably have one or more top edges 24 that are oriented upwardly and first and second bottom edges 25 that are oriented downwardly. The one or more back plate members 9 preferably are formed with fastener openings 26. Although the back plate members 9 are shown as splayed outwardly in opposite directions in FIGS. 1-9, they could both be bent inwardly to face each other between the first and second side members 11, or they could both be bent in the same direction, either left or right, with one between the first and second side members 11.

The joist hanger 2 of the present invention is preferably formed from sheet steel.

The first and second side members 11 preferably are planar as well, with first and second inner faces 27 that face the joist 3, and first and second outer faces 28 opposite the first and second inner faces 27.

Figure 4:
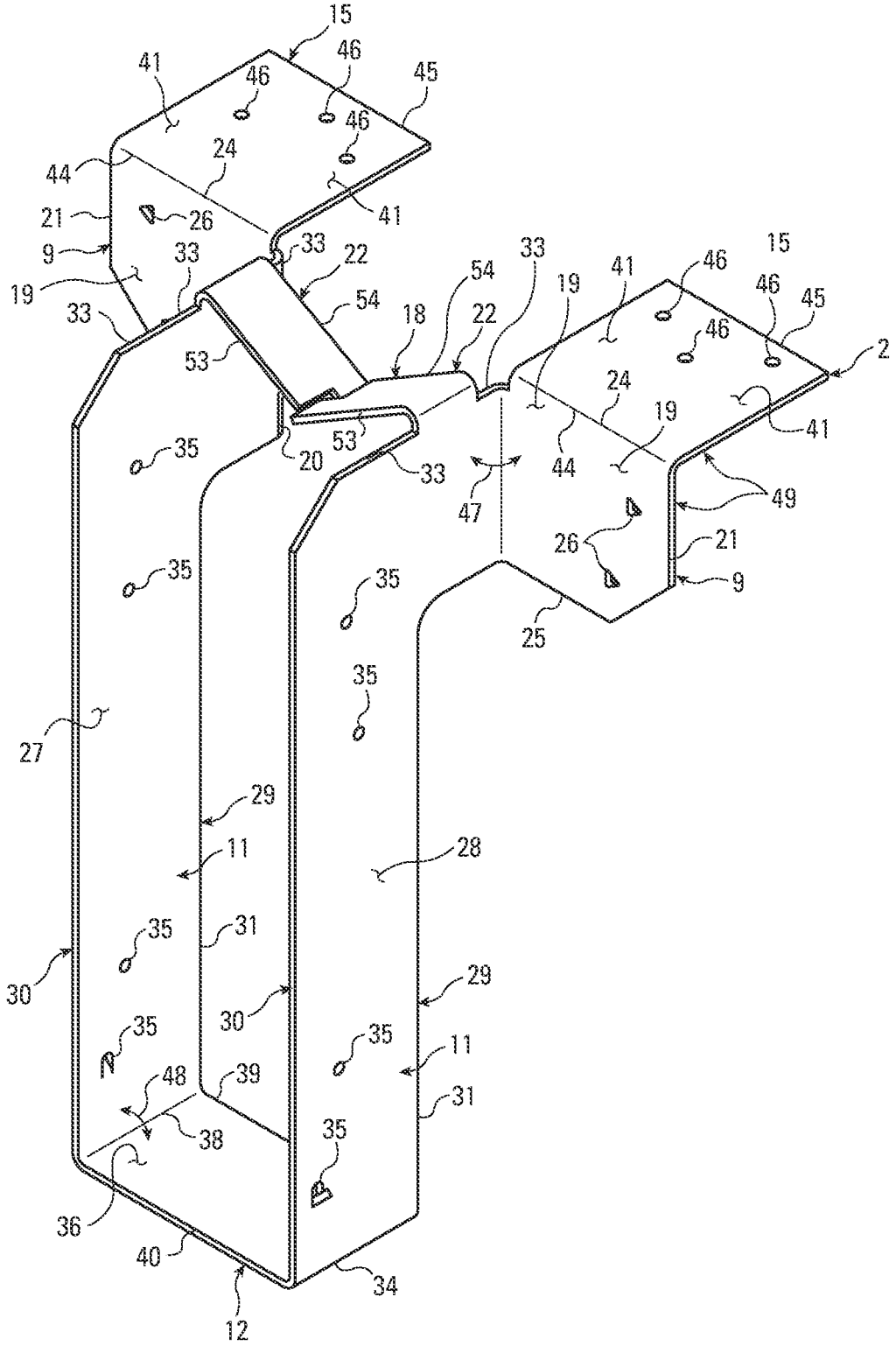
FIG. 4 is an upper right perspective view of the joist hanger shown in FIG. 1.

As shown in FIG. 4, the first and second side members 11 preferably have first and second back edges 29 that form an angular joint 47, preferably an orthogonal joint, where they meet the first and second inner edges 20 of the first and second back plate members 9. As shown in FIG. 4, the first and second back edges 29 of the first and second side members 11 form an angular joint 47 with the back plate members 9.

The first and second side members 11 preferably have first and second front edges 30 opposite the first and second back edges 29.

Figure 3:
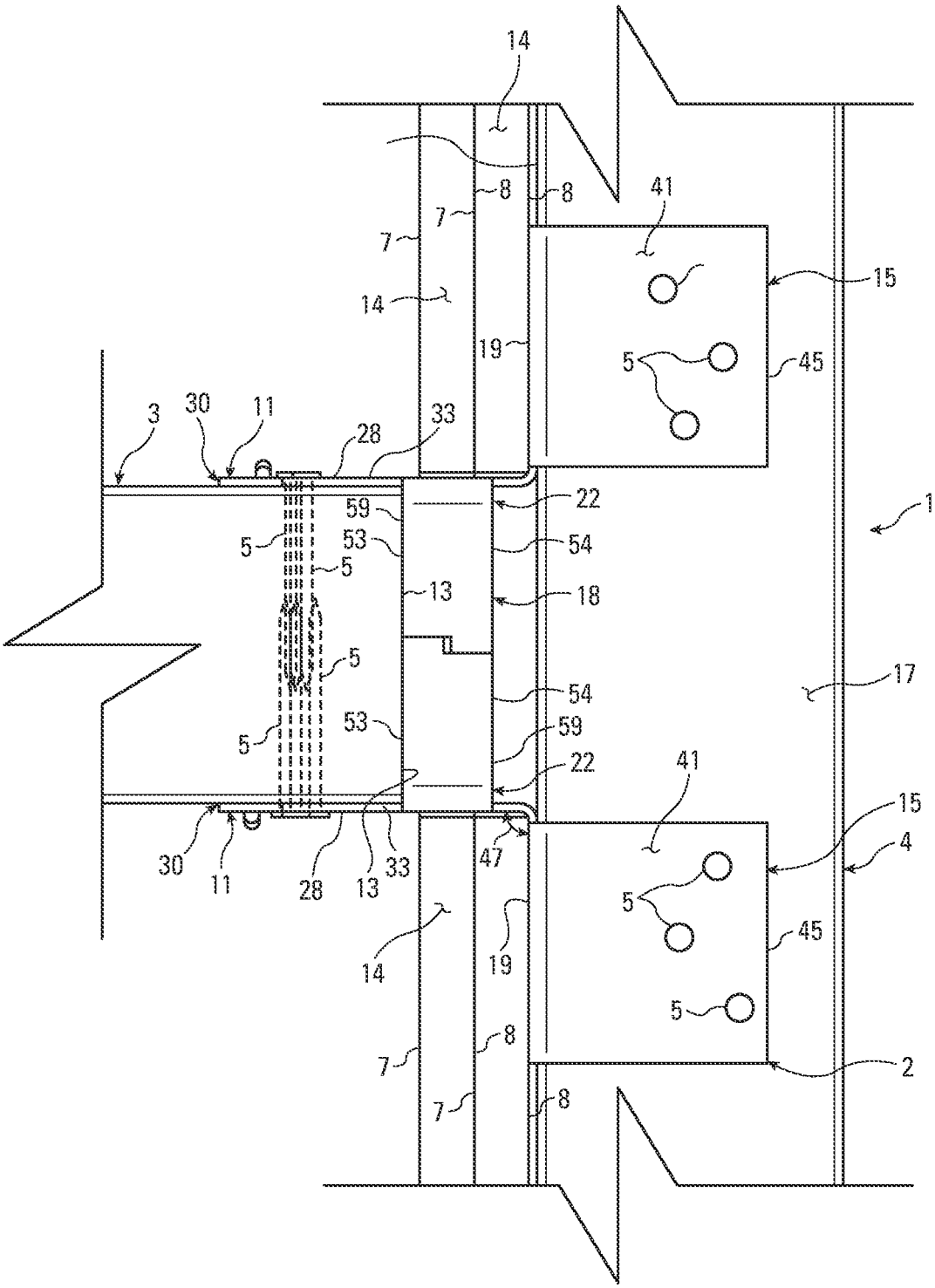
FIG. 3 is a top plan view of the connection shown in FIG. 1.
Figure 11:
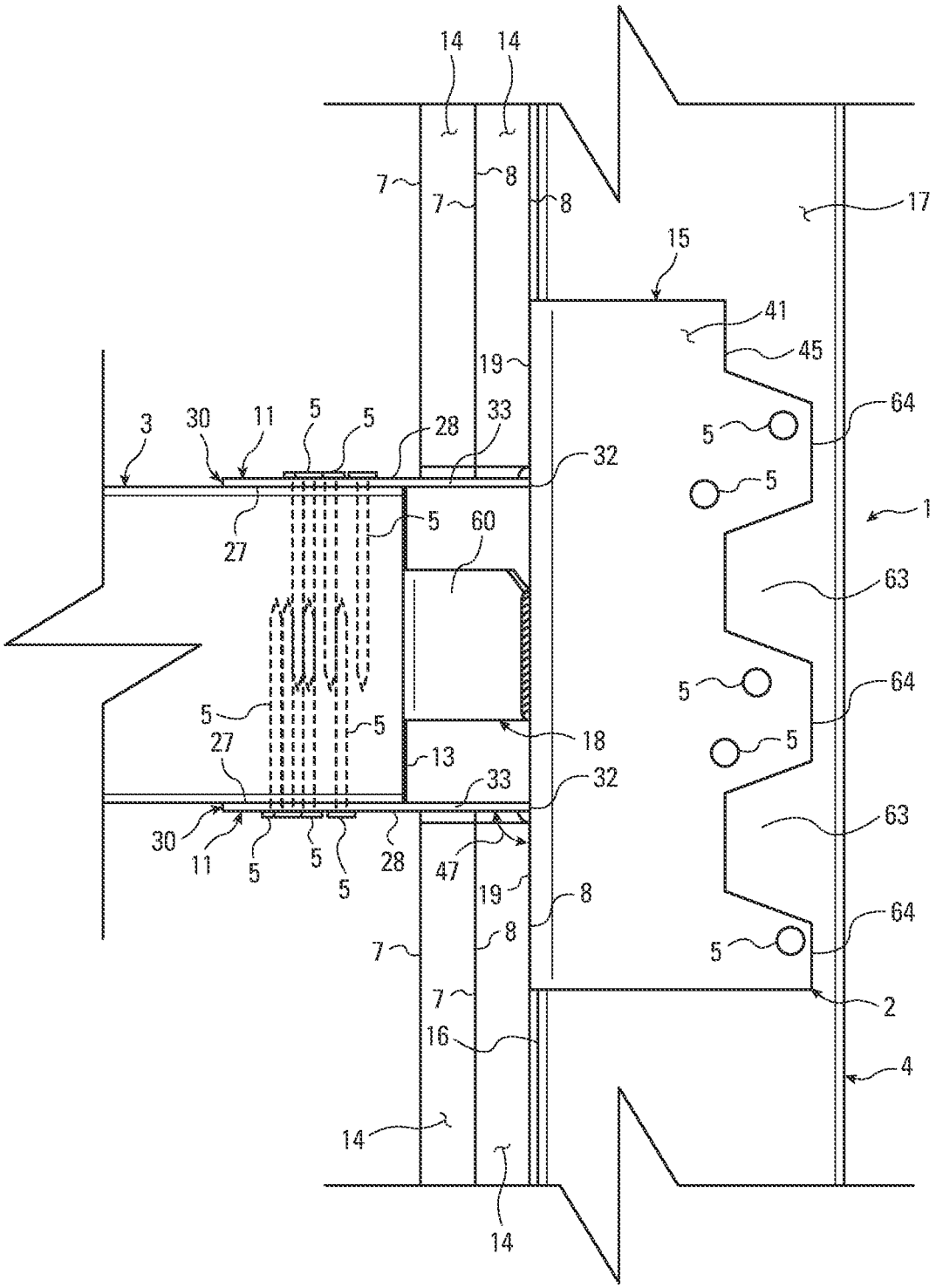
FIG. 11 is a top plan view of the connection shown in FIG. 10.
Figure 12:
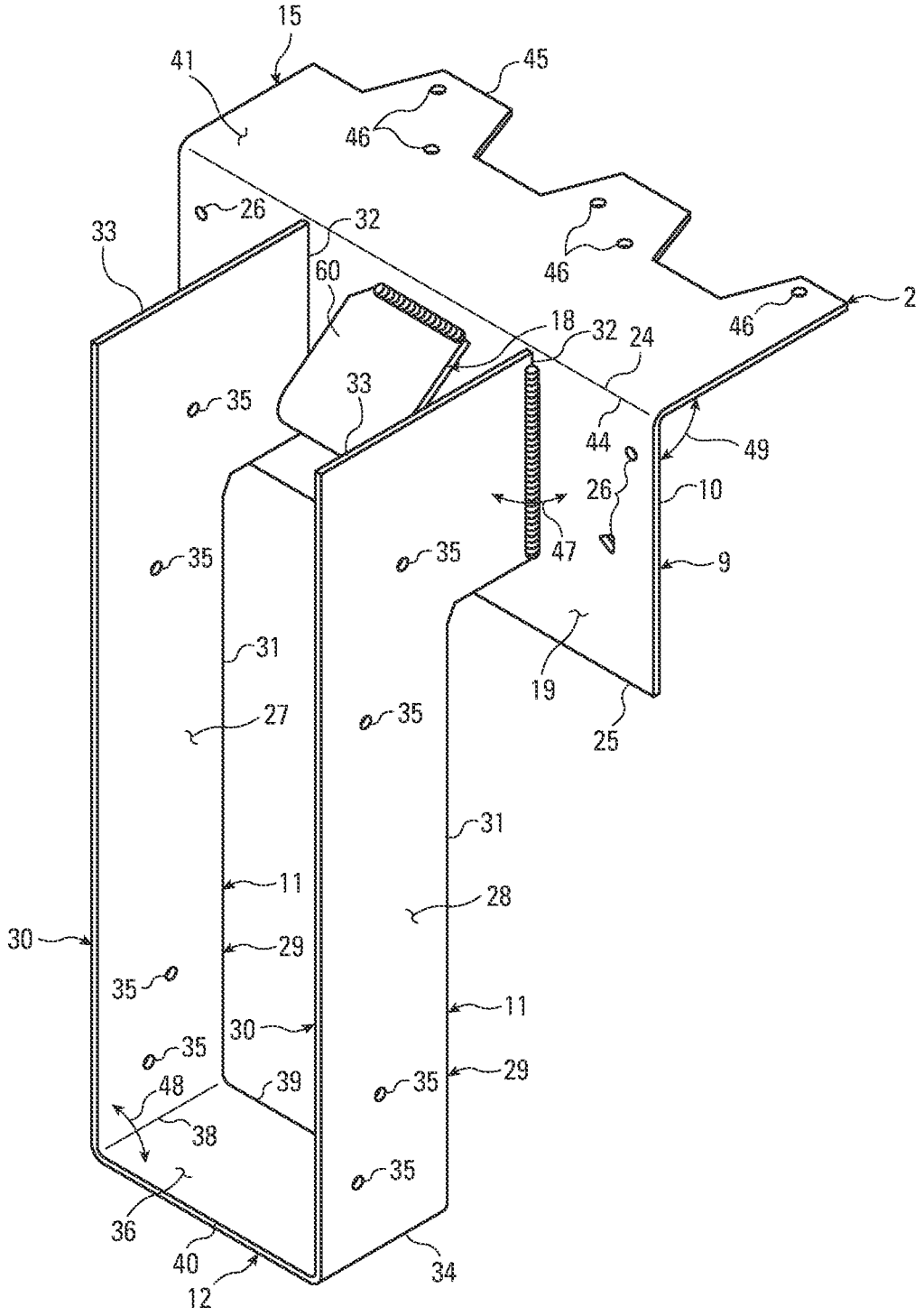
FIG. 12 is an upper right perspective view of the joist hanger shown in FIG. 10.
Figure 13:
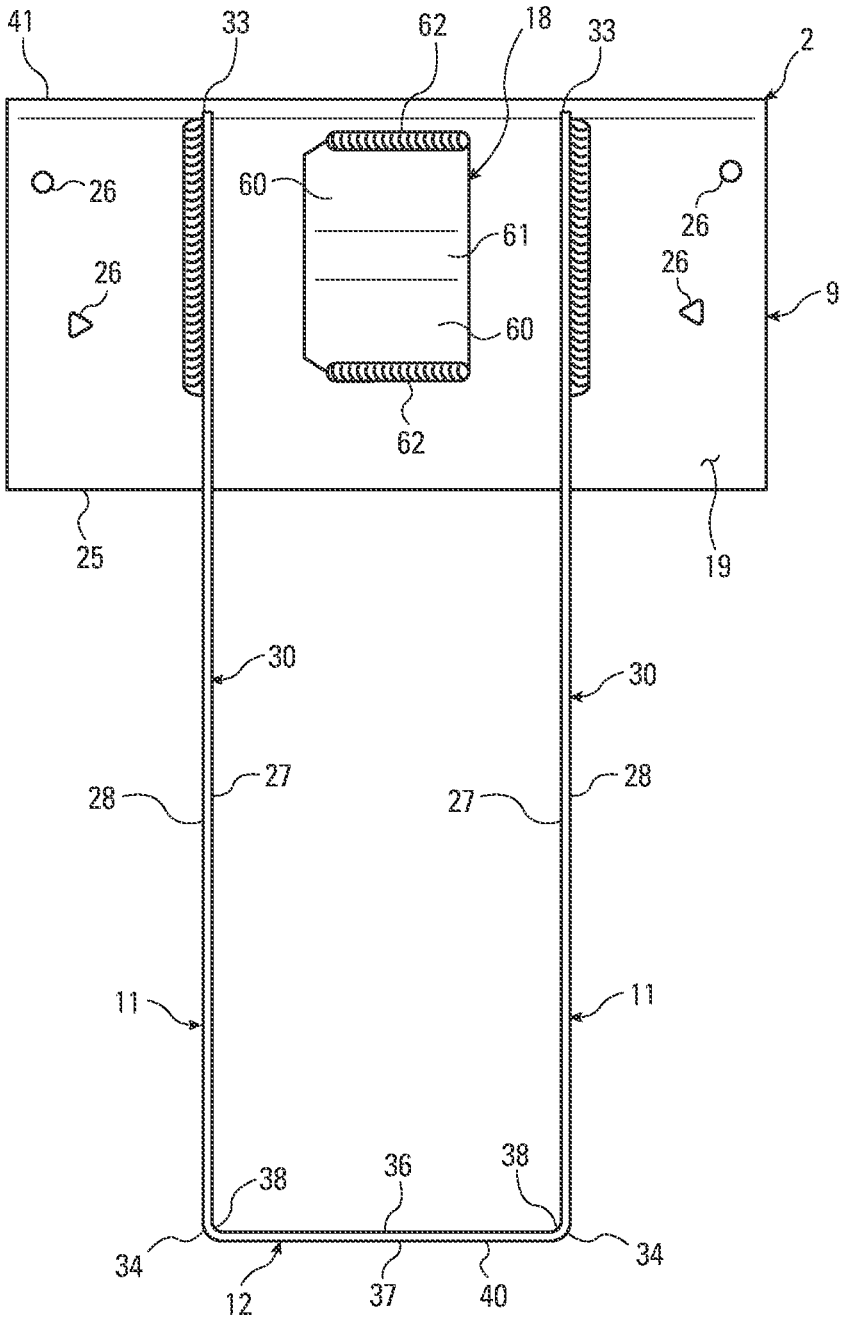
FIG. 13 is a front elevation view of the joist hanger shown in FIG. 10.
Figure 14:
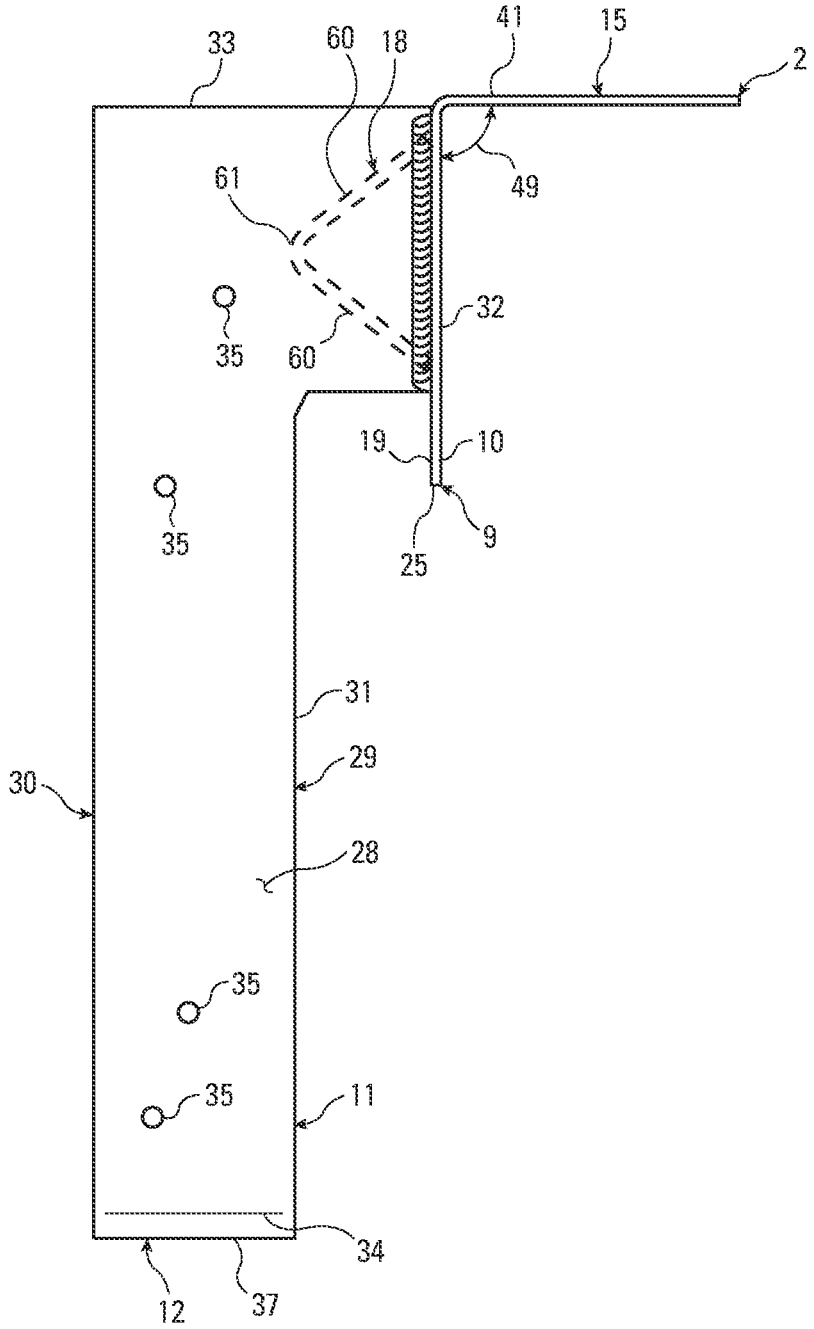
FIG. 14 is a left side elevation view of the joist hanger shown in FIG. 10.
Figure 15:
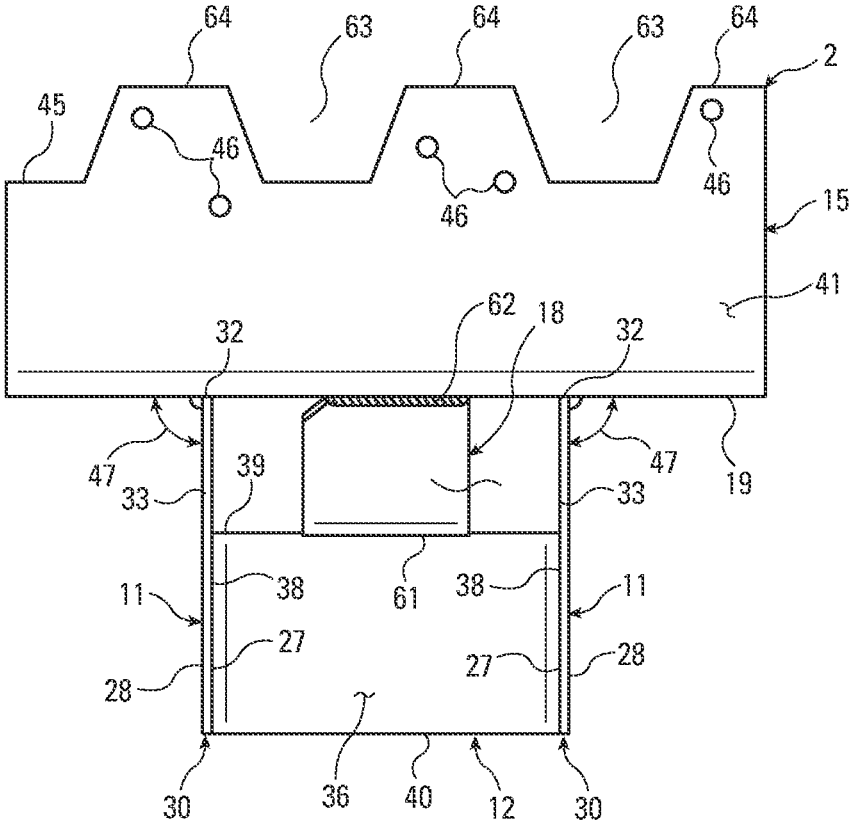
FIG. 15 is a top plan view of the joist hanger shown in FIG. 10.
Figure 16:
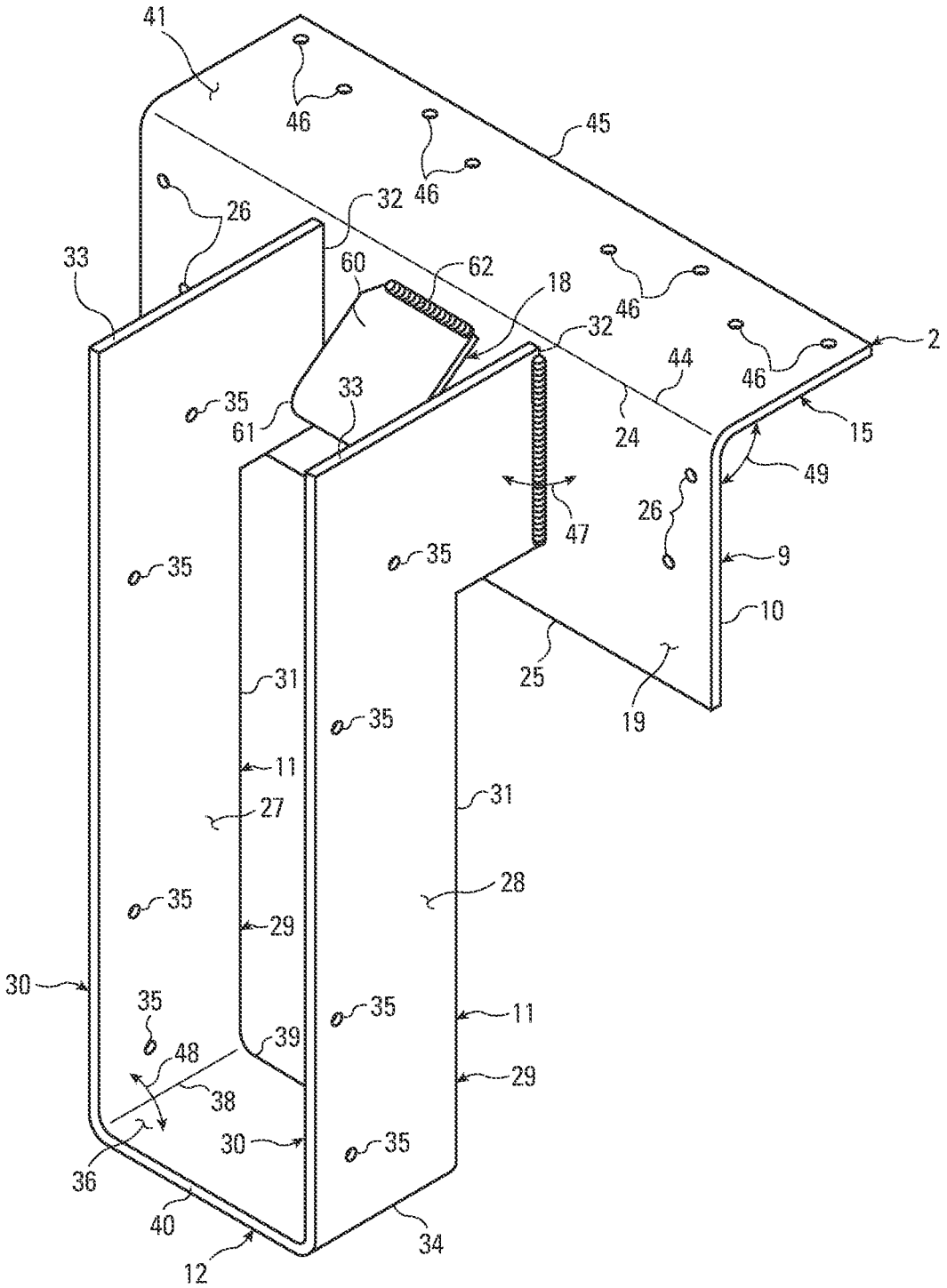
FIG. 16 is an upper right perspective view of an alternate joist hanger.

The first and second back edges 29 preferably have lower portions 31 and upper portions 32 with the first and second lower portions 31 being offset from the first and second upper portions 32. This creates space between the lower portion of the first and second side members 11 where the drywall panels 6 can be inserted behind the end of the joist 3 without having to notch or disturb these portions of the drywall panels 6. The side members 11 are generally L-shaped members with the upper portions extending through the drywall panels 6. As shown in FIG. 12 the upper portions 32 of the first and second back edges 29 are welded to the back plate 9. As shown in FIGS. 3 and 11, a stand-off member 18 can be attached to the hanger 2. The stand-off members hold the end or end surface 13 of the joist away from the front surface 7 of the drywall panel 6 closest to the end 13 of the joist 3. The lower portions 31 of the second back edges 29 are disposed in front of the front face or surface 7 of the outermost drywall panel 6 which is the front surface 7 of the drywall panel 6 closest to the end 13 of the joist 3.

The first and second side members 11 preferably have first and second top edges 33. As shown in FIG. 4, side top flanges 22 can be connected to the top edges 33 to strengthen the side members 11. As shown in FIG. 4, the side top flanges 22 can serve as the stand-off member 18. The first and second side members 11 also preferably have first and second bottom edges 34 opposite the first and second top edges 33. The first and second side members 11 preferably are formed with fastener openings 35.

The one or more panels 6 preferably are drywall panels 6. Drywall, otherwise known as plasterboard, wallboard, gypsum board, sheetrock, or gyprock, is typically a panel made of gypsum plaster pressed between two thick sheets of paper. It is used as part of interior walls and ceilings. In the United States and Canada, drywall panels are manufactured in 48-inch wide panels in varying lengths. Common panel thicknesses are ½-inch and ⅝-inch. In the present invention, two layers of ⅝-inch drywall is preferred. Drywall is naturally fire resistant and can be used to cover and protect the structural members of a building. However, gypsum is friable and has little or no dowel bearing strength. Other panel materials and qualities are also possible.

Preferably, the joist hanger has a seat member 12 interconnecting the first and second side members 11, and the joist 3 rests on the seat member 12 between the first and second side members 11.

Preferably, the back surface 8 of the rearmost drywall panel 6 and the upper portions 32 of the back edges 29 of the side members 11 contact or are in close proximity to the front face 16 of the structural support member 4. The side members 11 extend through the drywall panels 6. Preferably, the joist hanger 2 is not embedded in the structural support member 4, although it is attached to the structural support 4 member with fasteners 5, and while not shown the wall can have members above what is shown in the FIGS., including additional panels 6. The seat member 12 preferably has an upper face 36 that interfaces with the joist 3. The seat member 11 also preferably has a lower face 37 opposite the upper face 36, first and second linear side edges 38, a back edge 39 that can be orthogonal to the first and second side edges 38, and a front edge 40 that can be parallel to the back edge 39. The first and second side edges 38 preferably form an angular joint 48, where they meet the first and second bottom edges 34 of the first and second side members 11.

The joist hanger 2 has one or more top flanges 15 connected to the one or more back plate members 9. The one or more top flanges 15 preferably contact the top face 17 of the structural support member 4. Although, the top face 7 of the structural support member does not need to be the top of the wall, and additional panels 6 could be disposed above the panels shown 6. Preferably, the one or more top flanges 15 are fastened to the structural support member 4. The structural support member 4 preferably has a top face 17, the first and second top flanges 15 are fastened to the top face 17 of the structural support member 4. Preferably, the first and second top flanges 15 are fastened to the structural support member 5 with one or more fasteners 5. As shown these fasteners 5 can be nails.

The one or more top flanges 15 preferably are planar, with upper faces 41 and bottom faces 42 opposite the upper faces 41. Preferably, the bottom faces 42 contact the top face 17 of the structural support member 4. The one or more top flanges 15 preferably have front edges 44 and back edges 45. The back edges 45 can be formed with a series of spaced notches 63 with tabs 64 between the notches 63. The front edges 44 preferably form an angular joint 49, preferably orthogonally where they meet the one or more top edges 24 of the one or more back plate members 9. The first and second top flanges 15 can be formed with fastener openings 46. The tabs 64 can have fastener openings 46 for placing the fasteners 5 farther from the support member from face 16 while the notches 63 between the tabs 64 conserve material of the one or more top flange 15.

Typically, the structural support member 4 is a top plate 4 which can consist of one or more parts 50. The parts 50 of the top plate 4 can be two pieces of nominal 2"×4" or 2"×6" dimensional lumber 50. The structural support member 4 can include the studs 52 that support the structural support member 4 and make up the wall. Only a few studs 52 are shown in the drawings, but typically studs 52 will be spaced uniformly along and underneath the top plate with more studs 52 being used where more bearing strength is needed.

Preferably, each of the one or more panels 6 has a top edge face 14 and the structural support member 4 has a top face 17. In the preferred embodiment, only a small notch 51 is made in the one or more drywall panels 6 between the end 13 of the joist 3 and the structural support member 4 such that most of the top edge face 14 of each of the one or more panels 6 preferably is located at the level of the top face 17 of the structural support member or above the top face 17 of the structural support member 4, thereby helping to shield and protect the structural support member 4. Similarly, the drywall panels 6 are disposed between most of the end 13 of the joist 3 and the wall of which the structural support member 4 is a part.

Figure 7:
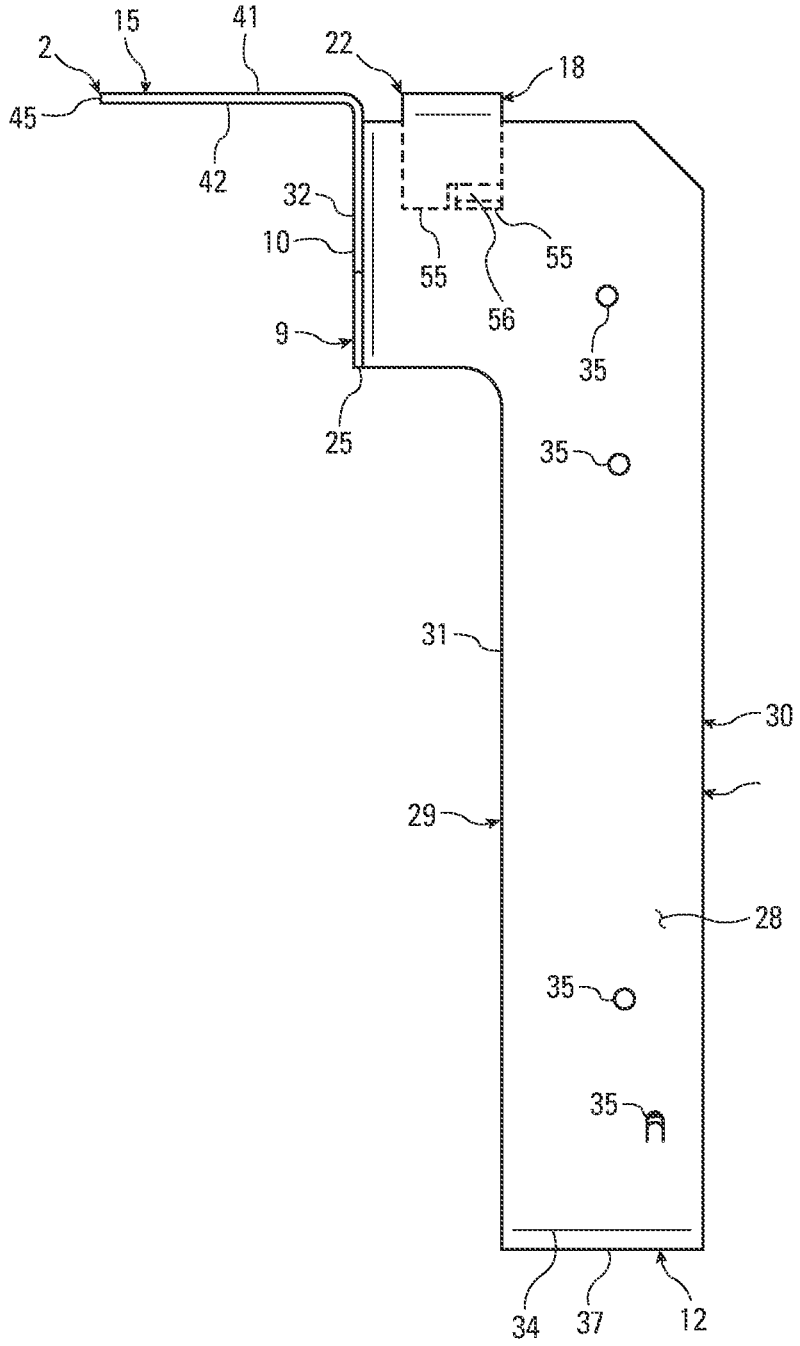
FIG. 7 is a right side elevation view of the joist hanger shown in FIG. 1.
Figure 8:
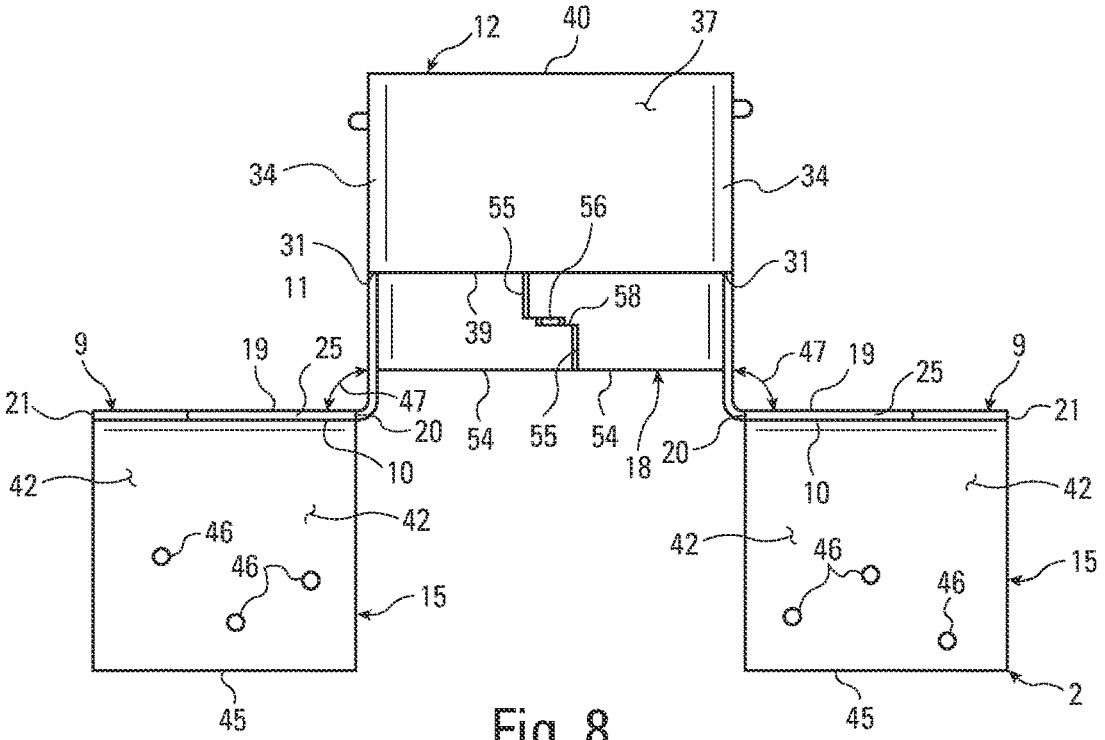
FIG. 8 is a bottom plan view of the joist hanger shown in FIG. 1.
Figure 9:
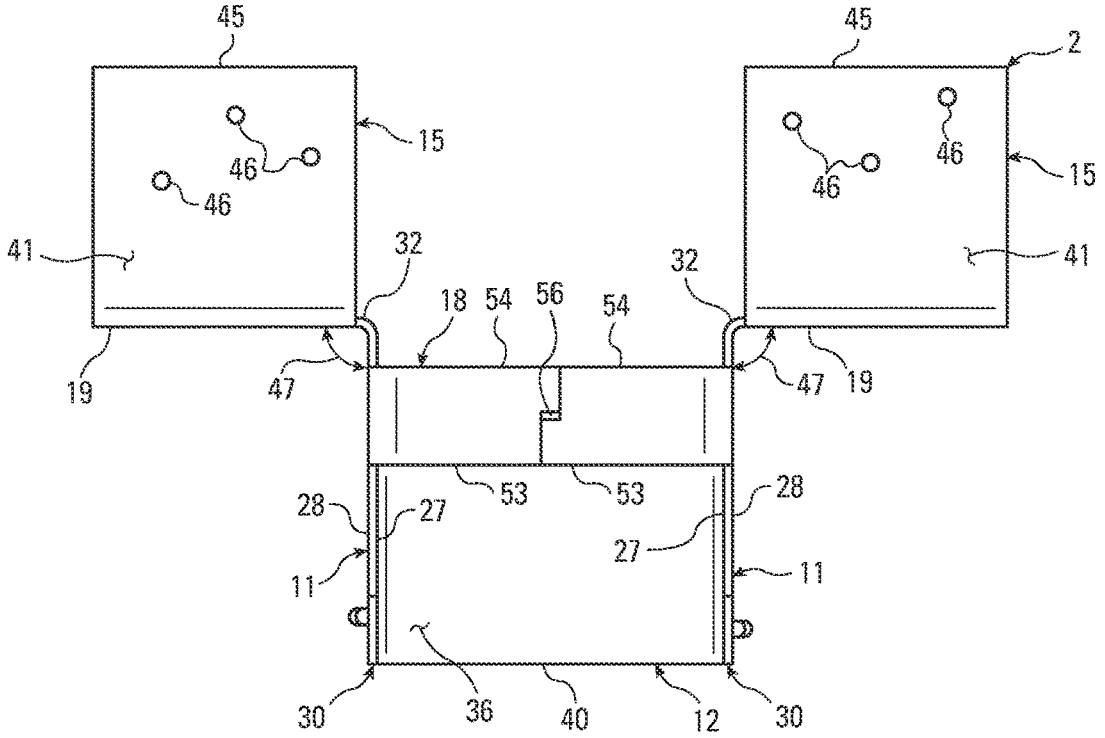
FIG. 9 is a top plan view of the joist hanger shown in FIG. 1.
Figure 10:
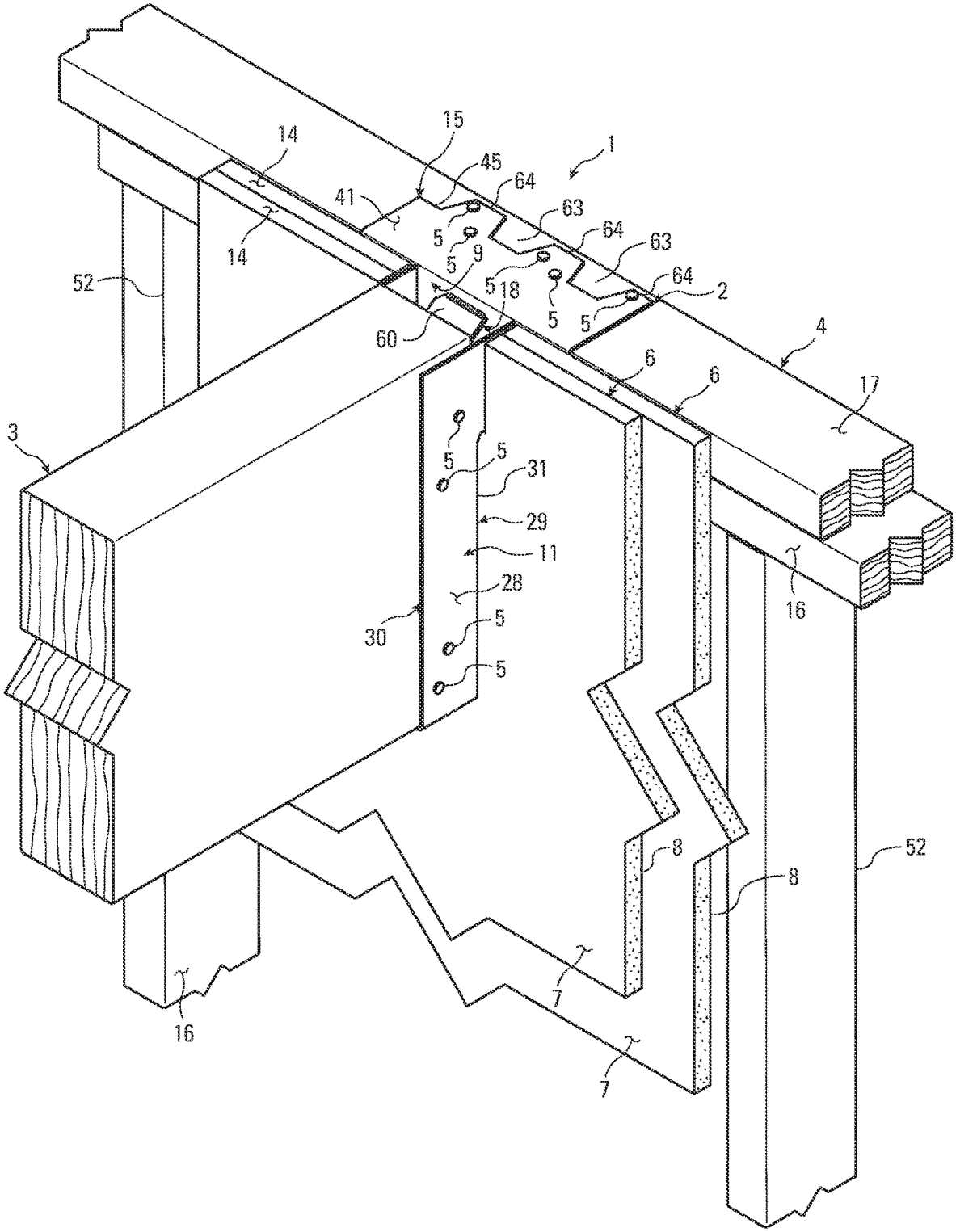
FIG. 10 is an upper right perspective view of an alternate joist hanger making the connection shown of the present invention.

As shown in FIGS. 4 and 7, the first back plate member 9 preferably has a first top edge 24, a first bottom edge 25, a first substantially vertical inner edge 20, a first outer edge 21 opposed to the first substantially vertical inner edge 20, and a first back face 10 adapted to be in parallel registration with the front face 16 of the structural support 4. Preferably, the second back plate member 9 also has a second top edge 24, a second bottom edge 25, a second substantially vertical inner edge 20, a second outer edge 21 opposed to the second substantially vertical inner edge 20, and a second back face 10 in parallel registration with the front face 16 of the structural support member 4.

Substantially all of the one or more back faces 10 of the one or more back plate members 9 preferably interfaces with the front face 16 of the structural support 4. The joist hangers 2 of FIGS. 10-16 are preferably formed by forming the back plate member 9 and the top flange 15 as a single piece and the seat member 12 and side members 11 as a single piece and joining the two parts together by welding. The joist hanger 2 of FIGS. 1-9 is preferably formed as a single piece of sheet metal that is bent into its final shape.

Figure 5:
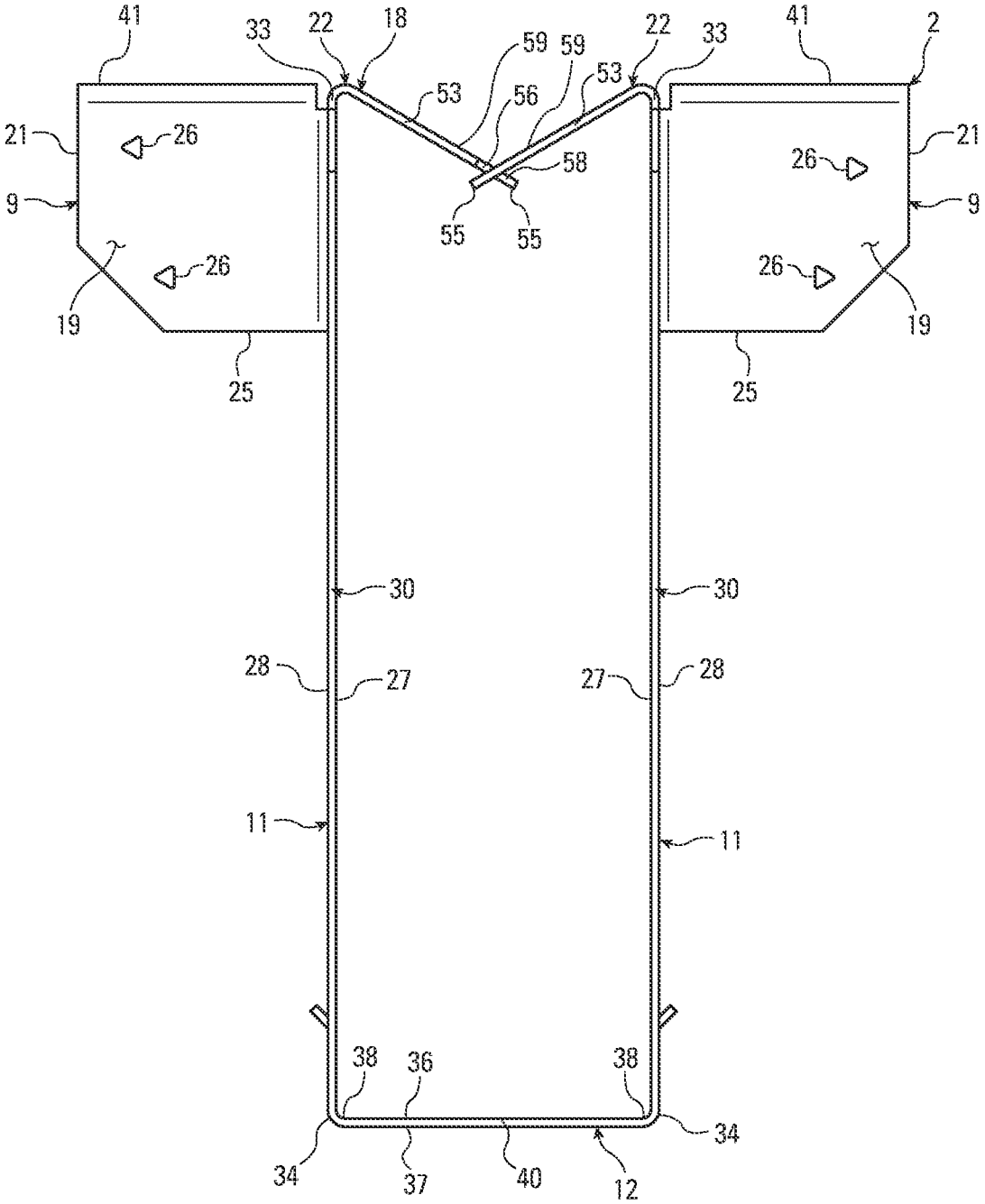
FIG. 5 is a front elevation view of the joist hanger shown in FIG. 1.
Figure 6:
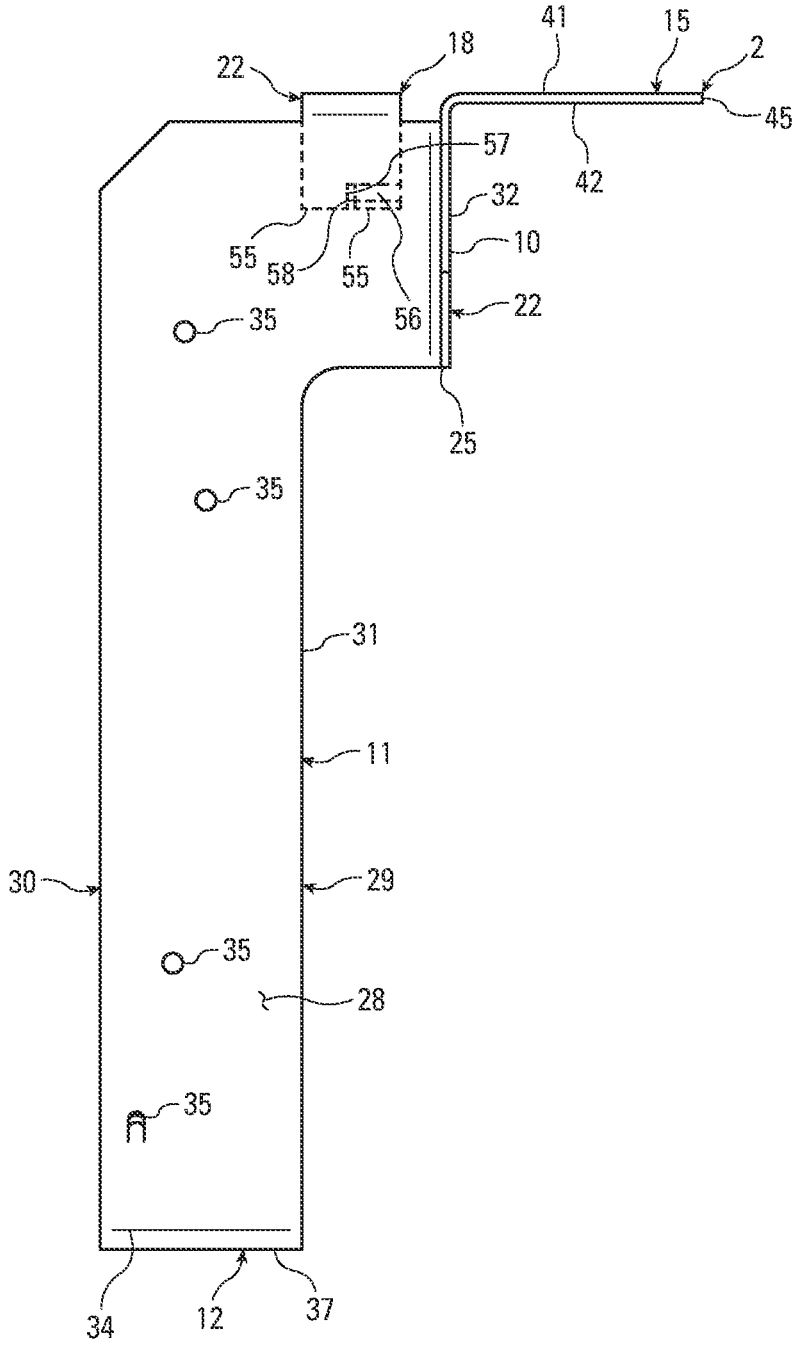
FIG. 6 is a left side elevation view of the joist hanger shown in FIG. 1.

As shown in FIGS. 3, 4 and 5, the stand-off member 18 can be formed as one or more side top flanges 22 bent from the side members 11. As shown, a side top flange 22 is bent from each side member 11 to form a pair of side top flanges 22. The side top flanges 22 are generally planar members except where they are bent from the side members 11, but the side top flanges 22 need not be generally planar. As shown in the FIG. 5, the side top flanges 22 overlap. The side top flanges 22 each have a front edge 53 and a back edge 54. As is also shown, preferably each side top flange 22 at a distal end 55 from the side member 11 is formed with a step 56 where the side top flanges 22 narrow. The steps 56 form median edge members 57 and 58 in the side top flanges with the median edge members 57 and 58 facing each other. The median edge member 57 on the side top flange 22 with the distal end 55 closer to the end face 13 of the joist 3 faces the structural support member 4, and the median 58 on the side top flange 22 with the distal end 55 closer to the structural support member 4 faces the end face 13 of the joist. As shown in FIGS. 3, 4 and 5 the step is preferably formed in the front edge 53 of one of the side top flanges 22 and the step is formed in the back edge 54 of the other of the side top flanges 22. The side top flanges 22 are bent from the side members 11 at the proximal ends 59 of the side top flanges. With the steps 56 in the side top flanges 22, a portion of the distal ends 55 of each side top flange 22 can be disposed below a portion of the proximal end 59 of the other of the side top flange 22. The stepped, overlapping of the side top flanges 22 can help the plurality of side top flanges 22 to work together to resist movement of the joist 3 towards the structural support member 4.

As shown in FIGS. 4 and 5, preferably the side top flanges 22 are bent at an acute angle to the respective side members 11 from which they depend.

As shown in FIGS. 11, 12, 13 and 14, a stand-off member 18 can be provided on the one or more back plates 9 of the hanger 2. As shown, the stand-off member 18 is a bent member attached to the back plate 9 of the hanger 2. The stand-off member 18 is a generally v-shaped member with two generally flat, planar members 60 meet at a large-radius bend 61. As shown in FIGS. 11, 12, 13 and 14, one or more welds 62 connect the stand off member 18 to the back plate 9.

We claim:

1. A connection (1) utilizing a joist hanger (2) to hang a joist (3) from a structural support member (4) in cooperation with a first plurality of fasteners (5) and one or more vertical drywall panels (6), the connection (1) comprising:

a. the one or more drywall panels (6) providing shielding to the structural support member (4), each having a front face (7), a back face (8) opposite the front face (7), the panels (6) being drywall panels such that they have negligible dowel bearing strength compared to the structural support member (4);

b. the plurality of fasteners (5) connecting the joist hanger (2) to the structural support member (4);

c. the structural support member (4) having a vertical front face (16) and the structural support member (4) having significant dowel bearing strength compared to the one or more drywall panels (6);

d. the joist (3) supported by the joist hanger (2), the joist having an end face (13) spaced away from the vertical front face (16) of the structural support member (4); and e. the joist hanger (2) supporting the joist (3), the joist hanger (2) comprising:

i. one or more back plate members (9) having one or more back faces (10) in parallel registration with the front face (6) of the wood structural support member (4);

ii. a first side member (11) connected to the one or more back plate members (9); and iii. a second side member (11) connected to the one or more back plate members (9), the first and second side members (11) having first and second back edges (29) with the first and second back edges (29) having first and second lower portions (31) and first and second upper portions (32), the first and second upper portions contacting and registering with the one or more back plate members (9) with the first and second upper portions (32) being spaced from each other where the first and second upper portions (32) contact and register with the one or more back plate members (9);

iv. one or more stand-off members (18) are connected to the joist hanger (2) that interface with the end face (13) of the joist (3) and space the end face (13) of the joist away from the vertical front face (16) of the structural support member (4); wherein:

f. portions of the one or more panels (6) are disposed between the end face (13) of the joist (3) and the structural support member (4) and the back face (8) of one panel (6) of the one or more panels (6) interfaces with the front face (16) of the structural support member (4); and wherein:

g. the one or more stand-off members (18) are attached only to the one or more back plate members (9) and are not connected to the first and second side members (11).

2. The connection (1) of claim 1 wherein:

the joist hanger (2) has a seat member (12) interconnecting the first and second side members (11); wherein the joist (3) rests on the seat member (12) between the first and second side members (11).

3. The connection (1) of claim 1 wherein:

a. the joist hanger (2) has one or more top flanges (15) connected to the one or more back plate members (9);

b. the structural support member (4) has a top face (17); and the one or more top flanges (15) are fastened to the top face (17) of the structural support member (4).

4. The connection (1) of claim 1 wherein:

a. each of the one or more panels (6) has a top edge face (14);

b. the structural support member (4) has a top face (17); and c. portions of the top edge face (14) of each of the one or more panels (6) is located at the level of the top face (17) of the structural support member or above the top face (17) of the structural support member.

5. The connection (1) of claim 1 wherein:

the first and second lower portions (31) being offset from the first and second upper portions (32), with the upper portions 32 contacting the one or more back plate members (9), and the lower portions being spaced away from the front face (16) of the structural support member (4).

* * * * *